US008616934B1

(12) United States Patent
Kern

(10) Patent No.: US 8,616,934 B1
(45) Date of Patent: Dec. 31, 2013

(54) DART TIP DEVICE

(76) Inventor: Steven Lee Kern, Campus, IL (US)

( * ) Notice: Subject to any disclaimer, the term of this patent is extended or adjusted under 35 U.S.C. 154(b) by 361 days.

(21) Appl. No.: 12/778,986

(22) Filed: May 12, 2010

(51) Int. Cl.
*A63H 5/00* (2006.01)

(52) U.S. Cl.
USPC ..... 446/400

(58) Field of Classification Search
USPC ..... 446/397, 398, 400, 404, 418; 473/578
See application file for complete search history.

(56) References Cited

U.S. PATENT DOCUMENTS

| | | | | | |
|---|---|---|---|---|---|
| 306,559 | A | * | 10/1884 | Vandercook | 446/400 |
| 1,425,198 | A | | 8/1922 | Hampel | |
| 1,502,198 | A | * | 7/1924 | Hill | 446/400 |
| 1,893,787 | A | | 1/1933 | Schroeder | |
| 2,119,524 | A | * | 6/1938 | Char | 446/400 |
| 2,183,152 | A | * | 12/1939 | Grieshaber et al. | 446/400 |
| 2,503,360 | A | * | 4/1950 | Stephenson | 446/400 |
| 2,534,976 | A | * | 12/1950 | Kidder | 446/400 |
| 2,611,999 | A | * | 9/1952 | Mikolay | 446/400 |
| 2,633,671 | A | * | 4/1953 | Felburg | 446/400 |
| 2,637,142 | A | * | 5/1953 | Kahn | 446/400 |
| 2,651,142 | A | * | 9/1953 | Buxton | 446/400 |
| 2,710,490 | A | | 6/1955 | Wildstein | |
| 2,751,711 | A | | 6/1956 | Greenwood | |
| 3,183,623 | A | * | 5/1965 | Callen | 446/400 |
| 3,352,056 | A | * | 11/1967 | Solomon | 446/400 |
| 5,707,270 | A | * | 1/1998 | Johnson et al. | 446/400 |
| D399,539 | S | | 10/1998 | Smith et al. | |
| 7,604,556 | B2 | * | 10/2009 | Witzigreuter | 473/577 |
| 7,775,918 | B2 | * | 8/2010 | Tsang | 473/572 |

* cited by examiner

*Primary Examiner* — Gene Kim
*Assistant Examiner* — Alyssa Hylinski

(57) ABSTRACT

An alternative dart tip device comprising first and second impact plates, the impact plates being positioned parallel to each other and the second impact plate being attached to a dart; a connecting means for connecting the impact plates and allowing the impact plates to be moved between a contact position and a non-contact position; a cap attachable to a top surface of the bottom impact plate; and a shaft having a first end attached to a bottom surface of the first impact plate and a second end extending downwardly toward the cap; wherein when the dart is thrown and impacts an object, the shaft penetrates the cap which causes the cap to explode.

2 Claims, 3 Drawing Sheets

DART TIP DEVICE

FIELD OF THE INVENTION

The present invention is directed to a toy projectile, more particularly to a projectile that pops a paper cap upon impact with an object.

BACKGROUND OF THE INVENTION

Darts and other projectiles are commonly used as toys. The present invention features a dart tip device comprising a paper cap that can be popped when the dart tip device impacts another object. The dart tip device may be attached to a standard dart in lieu of a traditional pointed dart end.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
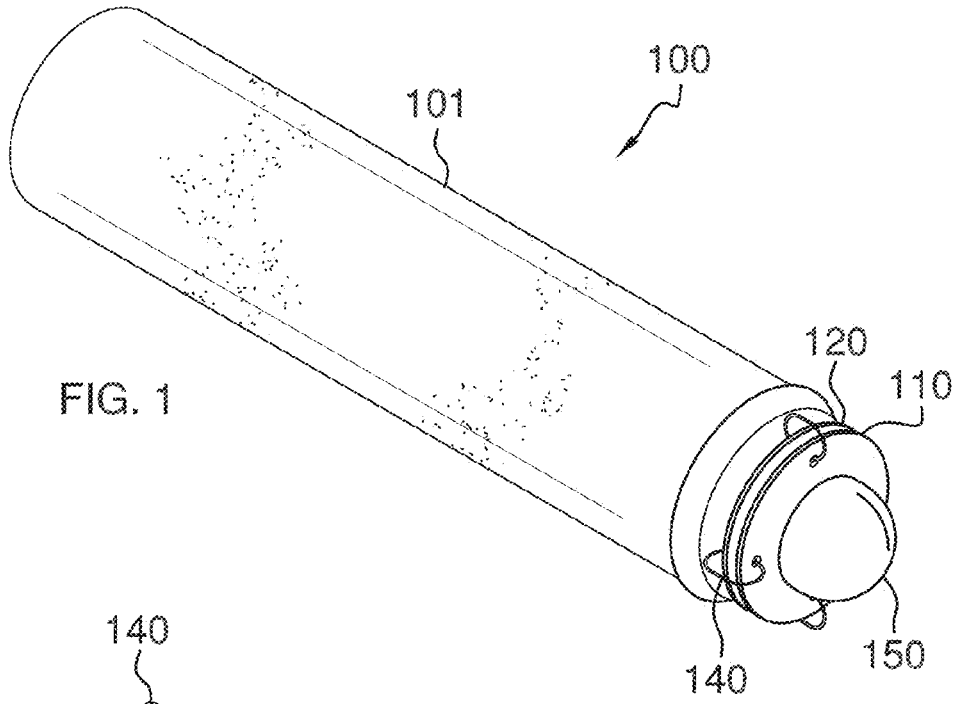
FIG. 1 is a front perspective view of the dart tip device of the present invention.
Figure 2:
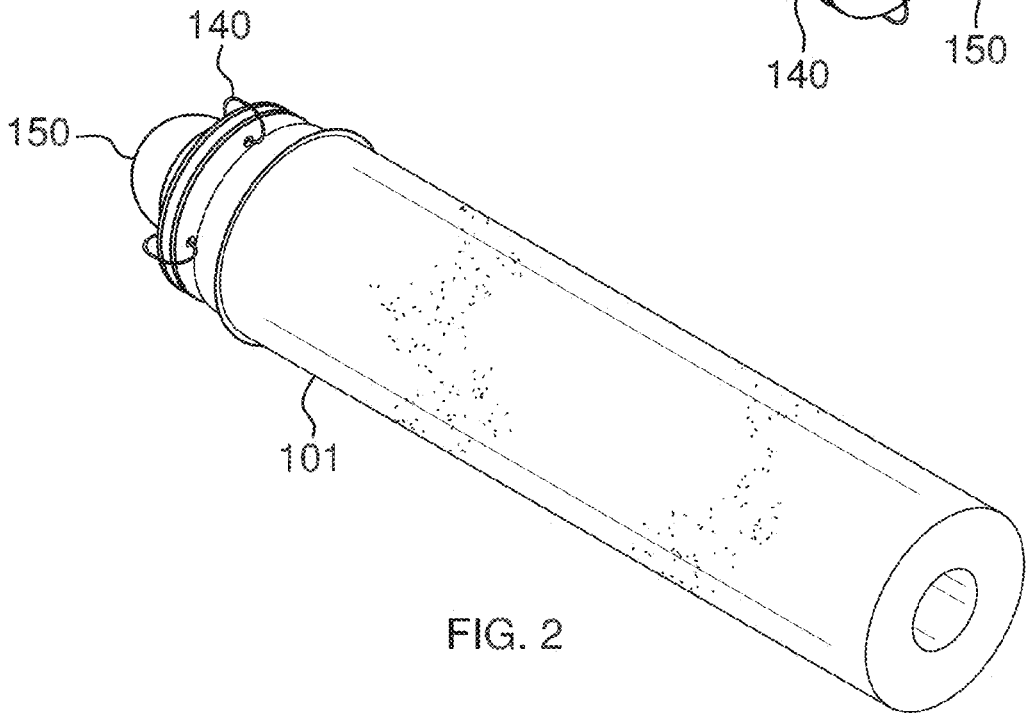
FIG. 2 is a back perspective view of the dart tip device of FIG. 1.

Referring now to FIGS. 1-5, the present invention features a dart tip device 100, which is an alternative dart tip. The dart tip device 100 comprises a paper cap that can be popped upon impact with a solid object. Generally, the dart tip device 100 can be reloaded with paper caps.

The dart tip device 100 comprises a first impact plate 110, a second impact plate 120 and a dart 101. The dart 101 is a cylindrical dart body 101 with a uniform diameter 170 along the whole length 190 of the body, wherein the body is free of any projection from exterior surface. The two impact plates 110, 120 are positioned parallel to each other and a certain distance apart. For example, the top surface of the second impact plate 120 may face the bottom surface of the first impact plate 110. The impact plates 110, 120 may be constructed in a variety of sizes. For example, in some embodiments, the impact plates 110, 120 are between about ⅛ to ½ inch in with, for example about ⅜ inch in width. In some embodiments, the impact plates 110, 120 are between about 1/64 to ¼ inch in thickness, for example about 1/32 inch in thickness. The impact plates 110, 120 are not limited to the aforementioned sizes.

Figure 3:
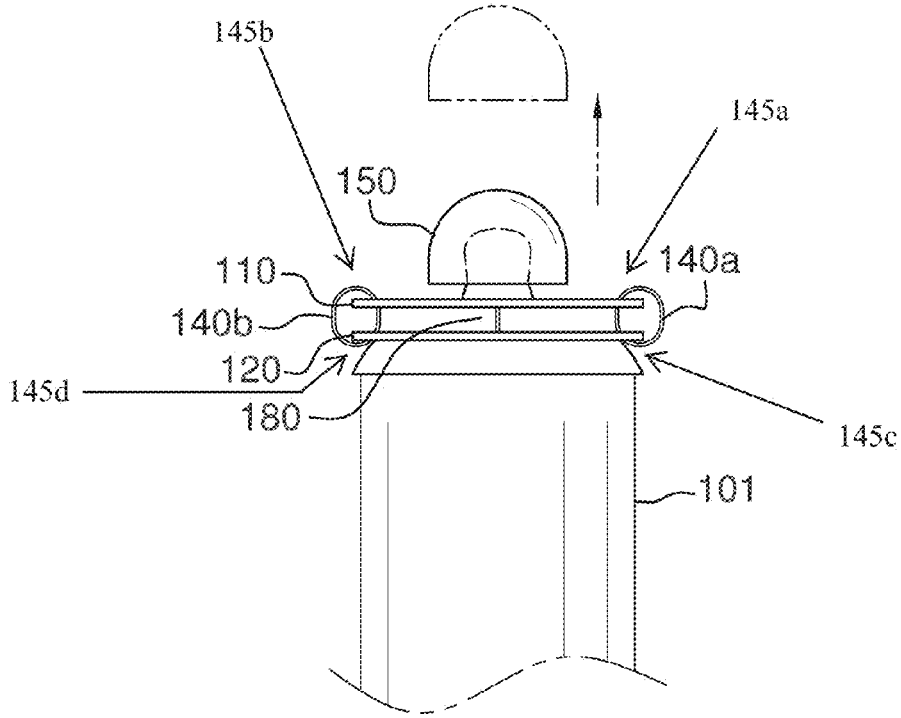
FIG. 3 is a side view of the dart tip device of FIG. 1.
Figure 4:
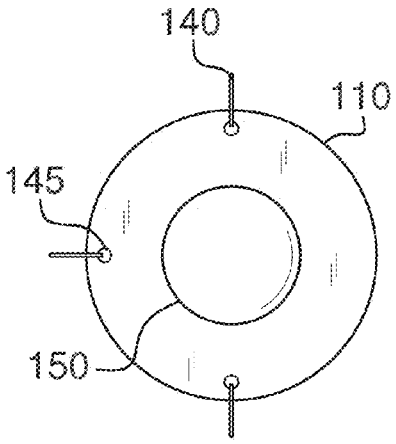
FIG. 4 is a top view of the dart tip device of FIG. 1.
Figure 5:
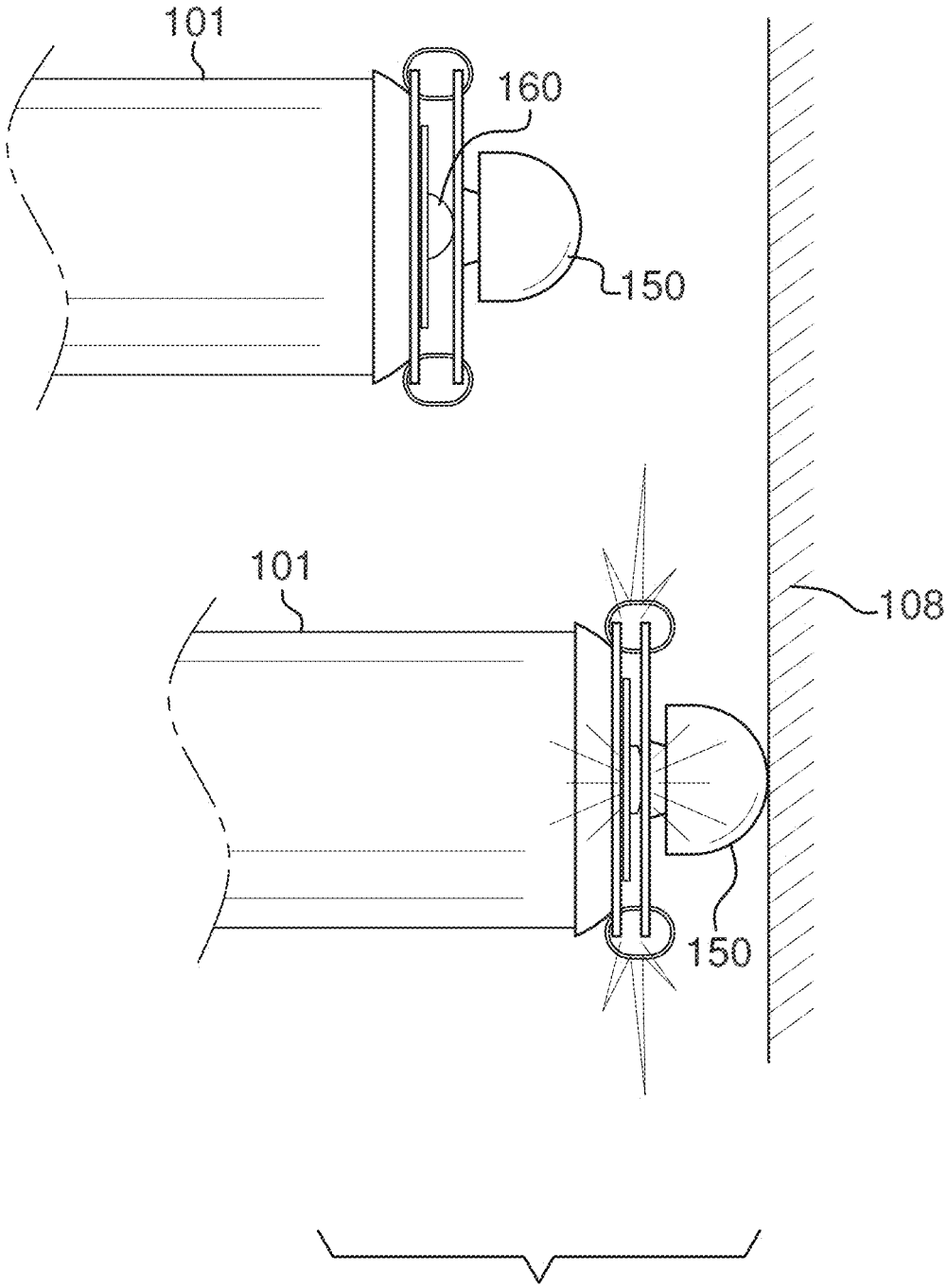
FIG. 5 is a second side view of the dart tip device of FIG. 1, wherein the dart tip device is in the non-contact position (above) and the dart tip device is in the contact position (below).

The impact plates 110, 120 may be connected together via a connecting means. In some embodiments, the connecting means comprises a first wire 140*a* attached to both the first plate 110 (e.g., at a first position on the first plate 110) and to the second plate (e.g., at a first position on the second plate 120). In some embodiments, a second wire 140*b* is attached to both the first plate 110 (e.g., at a second position on the first plate 110) and to the second plate (e.g., at a second position on the second plate 120). In some embodiments the first wire 140*a* and/or second wire 140*b* are wire loops. In some embodiments, the wires 140 connect to the plates 110, 120 via wire apertures 145 disposed in the plates 110, 120. The connecting means is not limited to wires 140. In some embodiments, the connecting means is a spring. As shown in FIG. 3, a first aperture 145*a* and second aperture 145*b* are disposed on a rim of the first impact plate, and third aperture 145*c* and fourth aperture 145*d* are disposed on a rim of the second impact plate.

The connecting means allows the first plate 110 and the second plate 120 to be moved between a contact position wherein the first plate 110 and second plate 120 are moved towards each other (in some cases contacting each other or nearly contacting each other) and a non-contact position wherein the first plate 110 and second plate 120 are apart a certain distance. In some embodiments, the first plate 110 and second plate 120 are between about 4/64 to 5/64 inches apart. The first plate 110 and second plate 120 generally need to be between about 4/64 to 5/64 inches apart so that the cap doesn't fall out and so the cap doesn't accidentally explode.

The second plate 120 (e.g., the bottom surface of the second plate 120) may be attached, for example fixedly attached, to the dart 101 at the tip end. In some embodiments, the second plate 120 is attached to a base, which is attached to the dart 101 at the tip end. The first plate 110 can move forwardly (e.g., away from the second plate 120) and backwardly (e.g., toward the second plate 120) with respect to the second plate 120 and dart 101.

In some embodiments, a tip 150 is disposed on the top surface of the first plate 110. The tip 150 may be removably attached to the first plate 110, for example via a snap mechanism. In some embodiments, the tip 150 is generally rounded. In some embodiments, the tip 150 is positioned generally in the middle of the first plate 110.

A cap 160 (e.g., bent cap) can be placed atop the second plate 120, for example the top surface of the second plate 120 (in between the first plate 110 and second plate 120). The device 100 of the present invention is designed such that the space between the first plate 110 and second plate 120 accommodates the cap 160 (e.g., bent cap) and holds the cap 160 (e.g., bent cap) snugly in place (e.g., the space is not too wide so the cap 160 falls out) while also allowing for the cap 160 to be loaded easily. Without wishing to limit the present invention to any theory or mechanism, it is believed that the present invention is advantageous because the cap can be easily loaded and released, and the device 100 provides better impact on the cap.

A shaft 180 extends downwardly from the first plate 110 (e.g., the bottom surface of the first plate 110). The first end of the shaft 180 is attached to the first plate 110 and the second end of the shaft 180 is positioned above the cap 160. The shaft 180 functions to penetrate the cap 160 so as to cause the cap 160 to explode. In some embodiments, the cap 160 causes a noise when penetrated.

In some embodiments, the cap 160 is folded to make it fit snugly between the second end of the shaft 180 and the top surface of the second plate 120.

When the dart 101 is thrown and the tip 150 impacts an object 108, the impact causes the first plate 110 to move toward the contact position. This causes the shaft 180 to penetrate the cap 160, causing the cap 160 to explode.

The dart tip device 100 may be constructed in a variety of sizes. In some embodiments, the dart tip device 100 is between about ¼ to ½ inch in width, for example about 7/16 inch in width. In some embodiments, the dart tip device 100 is more than about ½ inch in width. In some embodiments, the dart tip device 100 is between about ⅛ to ½ inch in height, for example about ⅜ inch in height. In some embodiments, the dart tip device is more than about ½ inch in height.

As used herein, the term "about" refers to plus or minus 10% of the referenced number. For example, an embodiment wherein the dart tip device 100 is about 1 inch in height includes a dart tip device that is between 0.9 and 1.1 inches in height.

The following the disclosures of the following U.S. Patents are incorporated in their entirety by reference herein: U.S. Pat. No. 2,751,711; U.S. Pat. No. 5,707,270; U.S. Pat. No. 1,425,198; U.S. Pat. No. 2,710,490; U.S. Pat. No. 2,637,142; U.S. Pat. No. 2,119,524; U.S. Pat. No. 1,893,787.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An alternative dart tip device (100) consisting of:

(a) a first impact plate (110) and a second impact plate (120), the impact plates (110, 120) being positioned parallel to each other, wherein a bottom surface of the second impact plate (120) is attached to a tip end of a dart (101), the dart (101) being a cylindrical body with a uniform diameter (170) along a whole length (190) of the body, wherein the body is free of any projection from an exterior surface;

(b) a connecting means for connecting the first impact plate (110) to the second impact plate (120), the connecting means allows the first impact plate (110) and the second impact plate (120) to be moved between a contact position where the first impact plate (110) and second impact plate (120) are moved towards each other to be nearly contacting each other and a non-contact position where the first impact plate (110) and second impact plate (120) are moved away from each other to be apart a certain distance, the certain distance being between about 4/64 to 5/64 inches; wherein the connecting means consists of (i) a first aperture (145*a*) and a second aperture (145*b*) disposed on a first rim of the first impact plate (110);

(ii) a third aperture (145*c*) and a fourth aperture (145*d*) disposed on a second rim of the second impact plate (120), the third aperture (145*c*) being aligned with the first aperture (145*a*) on the first impact plate (110) and the fourth aperture (145*d*) being aligned with the second aperture (145*b*) on the first impact plate (110);

(iii) a first wire (140*a*) looping through the first aperture (145*a*) of the first impact plate (110) and the third aperture (145*c*) of the second impact plate (120) to tie the first impact plate (110) and second impact plate (120) together;

(iv) a second wire (140*b*) looping through the second aperture (145*b*) of the first impact plate (110) and fourth aperture (145*d*) of the second impact plate (120) to tie the first impact plate (110) and the second impact plate (120) together;

(c) a cap (160) disposed on a top surface of the second impact plate (120); and (d) a shaft (180) having a first end attached to a bottom surface of the first impact plate (110) and a second end extending downwardly toward the cap (160), the shaft (180) functions to penetrate the cap (160) when the impact plates (110, 120) move to the contact position;

wherein when the dart tip device (100) is thrown and the first impact plate (110) impacts an object, the impact plates (110, 120) move to the contact position, and the shaft penetrates the cap (160) which causes the cap (160) to explode.

2. An alternative dart tip device (100) consisting of:

(a) a first impact plate (110) and a second impact plate (120), the impact plates (110, 120) being positioned parallel to each other, wherein a bottom surface of the second impact plate (120) is attached to a tip end of a dart (101), the dart (101) being a cylindrical body with a uniform diameter (170) along a whole length (190) of the body, wherein the body is free of any projection from an exterior surface;

(b) a connecting means for connecting the first impact plate (110) to the second impact plate (120), the connecting means allows the first impact plate (110) and the second impact plate (120) to be moved between a contact position where the first impact plate (110) and second impact plate are moved towards each other to be nearly contacting each other and a non-contact position where the first impact plate (110) and second impact plate (120) are moved away from each other to be apart a certain distance, the certain distance being between about 4/64 to 5/64 inches; wherein the connecting means consists of (i) a first aperture (145*a*) and a second aperture (145*b*) disposed on a first rim of the first impact plate (110), the second aperture (145*b*) being opposite the first aperture;

(ii) a third aperture (145*c*) and a fourth aperture (145*d*) disposed on a second rim of the second impact plate (120), the fourth aperture (145*d*) being opposite the third aperture (145*c*), the third aperture (145*c*) being aligned with the first aperture (145*a*) on the first impact plate (110) and the fourth aperture (145*d*) being aligned with the second aperture (145*b*) on the first impact plate (110);

(iii) a first wire (140*a*) looping through the first aperture (145*a*) of the first impact plate (110) and the third aperture (145*c*) of the second impact plate (120) to tie the first impact plate (110) and second impact plate (120) together;

(iv) a second wire (140*b*) looping through the second aperture (145*b*) of the first impact plate (110) and fourth aperture (145*d*) of the second impact plate (120) to tie the first impact plate (110) and the second impact plate (120) together;

(c) a cap (160) disposed on a top surface of the second impact plate (120); and (d) a tip (150) disposed on a top surface of the first impact plate (110); and (e) a shaft (180) having a first end attached to a bottom surface of the first impact plate (110) and a second end extending downwardly toward the cap (160), the shaft (180) functions to penetrate the cap (160) when the impact plates (110, 120) move to the contact position;

wherein when the dart tip device (100) is thrown and the tip (150) impacts an object the impact plates (110, 120) move to the contact position, and the shaft (180) penetrates the cap (160) which causes the cap (160) to explode.

* * * * *